United States Patent [19]

Gerding et al.

[11] 3,954,207

[45] May 4, 1976

[54] DOSAGE DISPENSER

[75] Inventors: Paul W. Gerding, Fort Wayne; Donald E. Head, Columbus, both of Ind.

[73] Assignee: Paul W. Gerding, Fort Wayne, Ind.

[22] Filed: Apr. 1, 1974

[21] Appl. No.: 456,454

[52] U.S. Cl. ..... 222/212; 222/530

[51] Int. Cl.[2] ..... B65D 37/00

[58] Field of Search ..... 222/530, 528, 529, 212, 222/215, 107, 386.5

[56] References Cited

UNITED STATES PATENTS

| | | | |
|---|---|---|---|
| 2,789,734 | 4/1957 | Biederman | 222/530 X |
| 2,957,614 | 10/1960 | Krajcovic | 222/530 X |
| 3,055,556 | 9/1962 | Hester | 222/530 X |
| 3,181,743 | 5/1965 | Libit et al. | 222/530 X |
| 3,506,163 | 4/1970 | Rauh et al. | 222/212 |

*Primary Examiner*—Stanley H. Tollberg
*Attorney, Agent, or Firm*—Lundy & Welch

[57] ABSTRACT

A small plastic dispenser, the sidewalls of the dispenser being manually collapsible. The top of the dispenser has a straw of resilient and flexible material connected thereto by which the contents of the dispenser can be discharged. The straw is foldable and collapsible so as to close the straw to fluid flow. The top has means thereon to hold the straw in a folded and collapsed condition. In a specific embodiment, the dispenser is integrally molded of a flexible and resilient material in the form of a container top and a container bottom. The container top and bottom have means thereon to form a liquid-tight seal therebetween after the dispenser is filled.

9 Claims, 6 Drawing Figures

DOSAGE DISPENSER

BACKGROUND OF THE INVENTION

1. Field of the Invention

This invention relates to a container for single or multiple dose quantities of a liquid or other flowable substances such as pastes having high viscosity or powders. The dispenser is especially suitable in dispensing metered quantities of a material, and where such applications are of a pharmaceutical nature, the dispensed material may be delivered direct from the dispenser orally through the straw in the exact measure desired.

2. Description of the Prior Art

There exists in the art a system for preparation and distribution of individual dosage units of pharmaceutical materials. A patent generally describing such a system is U.S. Pat. No. 3,512,858, issued on May 19, 1970 to Kenneth D. Relyea. It is a common experience of persons who must work with recalcitrant and senile patients to find that such patients may attempt to conceal in their mouth and later dispose of a pill or capsule or dry-type medical preparations. Accordingly there is a need for an improved type of oral administration of medical preparations.

SUMMARY OF THE INVENTION

It is therefore a primary object of this invention to provide an improved dosage dispenser.

It is another object of this invention to provide an improved dosage dispenser which would have a volume ranging from miniscule to multiliter so as to be useful in administering both single and multiple dose quantities of medical preparations.

Another object of this invention is to provide an improved dispenser having a dispensing aperture through which the contents of the dispenser can be ejected in a manner to accomplish nearly perfect evacuation of the dispenser while metering the ejection output with unitized precision.

Another object of this invention is to provide a simple two-piece molded plastic dispenser which can easily be filled and closed to provide an air-tight and liquid-tight container.

Another object of this invention is to provide an improved dispenser affording nearly an absolute bacteriafree environment for the contents while the container is stored, and when used would not require the dispensing aperture to be touched by human hands during the administration of the contents.

At further object of this invention is to provide an improved dispenser having all of the objects above-mentioned, which is capable of being manufactured relatively inexpensively so as to be disposable after a single use.

In the broader aspects of this invention, there is provided a closed container having a top and bottom. The bottom has upstanding sidewalls which at least a portion thereof are manually collapsible. Both the bottom and top have means adjacent their periphery for cooperatively forming a liquidtight seal therebetween. A tube is connected to the container top which communicates with the interior thereof. The tube is collapsible to prevent the transmission of the contents of the container through the tube and is resilient such that it will again regain its tubular shape and allow the contents of the container to be dispensed therethrough when desired.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings, wherein.

DESCRIPTION OF THE PREFERRED EMBODIMENT

Figure 6:
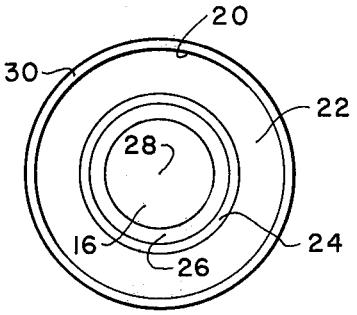
FIG. 6 is a bottom view of the improved dispenser of the invention.
Figure 4:
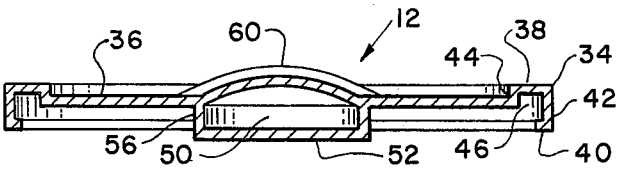
FIG. 4 is a sectional view of the top of the improved dispenser of the invention taken substantially along the section line 4—4 of FIG. 2.

Now, referring to the drawings, there is shown the improved dispenser 10 of the invention. The dispenser 10 has a top or lid 12 and a bottom or cup 14. The cup 14 has a bottom 16 and upstanding sidewalls 18. The sidewalls 18 are composed of several sections 20, 22, 24 and 26. The cup 14 is of circular configuration and shown in FIG. 6 and has a centrally located axis 28 about which the bottom 16 and each of the sidewall sections 20, 22, 24 and 26 are coaxially arranged. Cross-sections taken substantially perpendicularly of the axis 28 of the cup 14 are circular in every instance.

Additionally, except as otherwise pointed out, the cup 14 is of a thin-walled construction of generally uniform thickness, and each of the wall sections 20, 22, 24 and 26 are of the same general thickness of material. Further, each of the wall sections 20, 22, 24 and 26 are frusto-conical in shape, and thus have both tapered interior and exterior surfaces. Cross-sections taken generally perpendicularly of the axis 28 adjacent the upper boundaries of sections 20, 22, 24 and 26 will always be larger in diameter than cross-sections taken adjacent the lower boundaries thereof. The term "upper" and "lower" are used herein with reference to the manner in which the dispenser is illustrated in FIGS. 1 and 3 wherein the bottom 16 is the lowest portion of the dispenser and the wall section 20 is the upper section of the sidewall 18.

The wall section 20 and wall section 24 are tapered to a relatively small degree when compared to the taper of wall sections 22 and 26. Both wall sections 20 and 24 are tapered only to the degree necessary to allow the cup to be inserted into a cylindrical opening relatively easily and to be maintained in that opening by friction between the exterior surface thereof and the interior surface of the cylindrical opening. Wall section 22 has the most severe taper and wall section 26 has an intermediate taper. Both of these tapers are to allow the wall sections 22 and 24 to be manually compressible and collapsible inwardly when pressure is exerted on the bottom 16 and the bottom 16 is urged toward the lid 12. The taper of wall section 22 is more severe than that of wall section 26 such that the wall section 22 collapses inwardly before the wall section 26 upon compressing the dispenser 10 as above-described.

Figure 1:
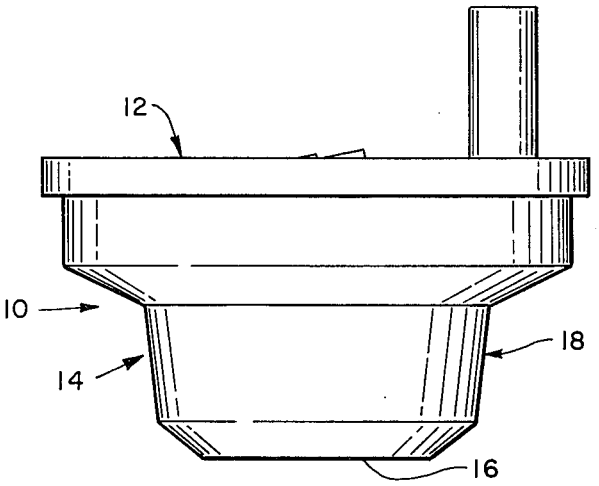
FIG. 1 is a side view of the improved dispenser of the invention with its tube or straw in its erect position.
Figure 3:
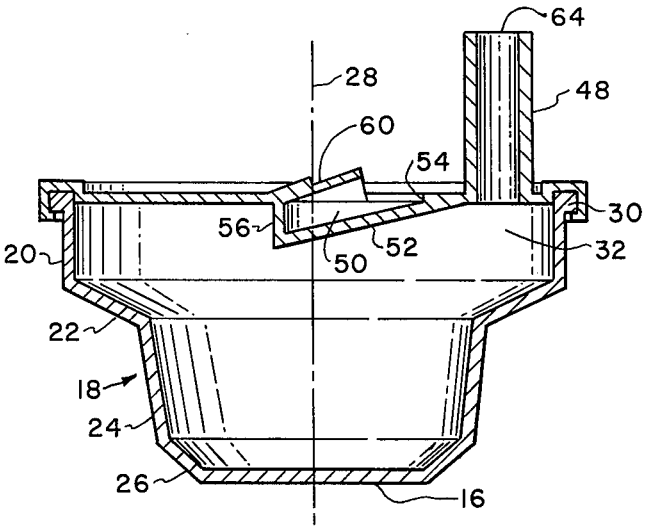
FIG. 3 is a cross-sectional view of the improved dispenser of the invention taken substantially along the section line 3—3 of FIG. 2.
Figure 5:
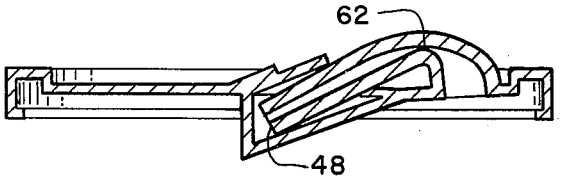
FIG. 5 is a sectional view of the top of the improved dispenser of the invention taken substantially along the section line 3—3 of the invention showing the tube or straw in its folded and crimped condition.

As is shown in FIGS. 1, 3 and 5, wall section 22 is connected to and positioned between wall sections 20 and 24. Wall section 24 is connected to and positioned between wall sections 22 and 26. Similarly, wall section 26 is connected to and between wall section 24 and bottom 16.

Wall section 20 has at its distal end a peripheral lip 30 which defines the access opening 32 of the cup 14. The peripheral lip 30 in cross-section is rectangular and has a thickness greater than wall sections 20, 22, 24 and 26. The peripheral lip 30, as will be mentioned hereinafter, provides a means which cooperates with the lid 12 to form a liquidtight seal between the lid 12 and the cup 14. The only other portion of the cup 14 which has a thickness greater than the wall sections 20, 22, 24 and 26 is the bottom 16. This is shown in FIG. 3.

Now referring to FIGS. 1 through 5, lid 12 now will be described in detail. Lid 12 is circular in cross-sections taken perpendicular to axis 28. Lid 12 has a peripheral rabbet 34 which completely surrounds the inner disc shaped portion 36. Rabbet 34 has a top flange 38, a bottom flange 40, a side flange 42 and is connected to the disc portion 36 by means of a flange 44. Flanges 38, 40, 42 and 44 define a space therebetween which is complementary to the lip 30. Both the lip 30 and the space 46 are rectangular in shape in cross-section. Adjacent rabbet 34 there is positioned the tube or straw 48. Straw 48 is a thin-walled cylindrical tube which communicates with the interior of the dispenser 10 when the lid 12 is connected to the cup 14.

Figure 2:
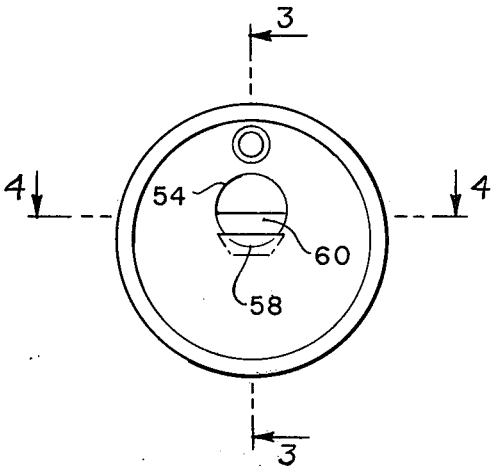
FIG. 2 is a top view of the improved dispenser of the invention as illustrated in FIG. 1.

Positioned inwardly of the disc-shaped portion 36 along the same diameter as tube 48 is positioned is the recess 50. Recess 50 is circular in a top view as shown in FIG. 2. Recess 50 has a sloping bottom 52 which at one point 54 thereof substantially merges with disc-shaped portion 36. Otherwise defining recess 50 is cylindrical sidewall 56 which extends between the disc-shaped portion 36 and bottom 52. Point 54 being the shallowest point of recess 50, point 58, which is on the same diameter as tube 48 and point 54, is the deepest point of recess 50. Overlying generally one-half of the recess 50 is a cover portion 60. Cover portion 60 is made of material thicker than disc-shaped portion 36, and is thus reinforced so as to be more rigid than the remaining portion of lid 12.

As shown in FIG. 5, the length of tube 48 and the distance between tube 48 and recess 52 is such that the tube 48 can be folded over against the surface of disc-shaped portion 36 so as to collapse or crimp the tube 48 at point 62 and position the distal end 64 of the tube 48 in recess 50 between the bottom 52 and the cover 60. The cover 60 holds the tube 48 in its crimped condition as shown in FIG. 5.

As shown in FIG. 3, lid 12 can be positioned on cup 14 in a manner to form a liquid-tight seal therebetween. Forming the seal is lip 30 and rabbet 34. When lip 30 is properly positioned in space 46, lip 30 is firmly grasped between flanges 38, 40, 42 and 44 on lip 34.

As above-described, it is contemplated that both the lid 12 and the cup 14 can be molded of a flexible and resilient plastic. The liquid-tight seal between the lip 30 and the lip 34 requires both flexibility and resiliency in the material from which both lid 12 and the cup 14 are formed. Similarly, the tube 48 must be flexible to be collapsed and crimped as shown in FIG. 5 and must be resilient to reassume its position as shown in FIGS. 1 and 3 in order for the contents of the dispenser 10 to be discharged therethrough. Also, as above-described, the cup 14 is formed in a manner whereby the sidewall sections 22 and 26 collapse upon compressing the cup bottom 16 toward the lid 12.

In a specific embodiment, both the cup 14 and the lid 12 can be molded as a single piece from a plastic material. Both polypropylene and polyethylene are suitable plastics for this purpose.

In operation, the cup 14 is filled, typically with a liquid. Tube 48 is folded and crimped and secured within the recess 50 as shown in FIG. 5. The lid 12 is then secured to the cup 14 closing the dispenser 10. When filled with a pharmaceutical preparation, suitable indicia indicating the dosage contained in the dispenser, the name of the patient or the like can be attached to the exterior surface of the disc-shaped portion of the lid 12.

when the dosage is desired to be dispensed, the tube 48 can be removed from the recess 50 and extended into the position shown in FIGS. 1 and 3. With the tube 48 in this position, the contents of the dispenser 10 can be poured from the dispenser through the tube 48, sucked from the dispenser by the patient using the tube 48 as a straw, or discharged from the dispenser through the tube by compressing the dispenser. In this latter regard, the dispenser can be held between two fingers and the thumb of a person's hand, the thumb being on the bottom 16 and compressed therebetween. By any of these manners, the dispenser can be partially or completely discharged.

In the instance of the application of a medical preparation from the dispenser of the invention, to a very aged person or to a very young person, the tube 48 is placed directly into the mouth and the container's contents can be safely and cleanly emptied by the methods afore-described. By this means, the vexing problems of pouring from a bottle to a spoon without spilling the medical preparation while at the same time coaxing or fighting the baby or the aged person to "open up" is obviated. Similarly, at times, the oral or esophageal muscles of an aged person are often so weak that he cannot "use a straw," in this case the dispenser's contents can either be poured from the dispenser or forced out by compressing the cup as mentioned above. Such also solves the problem when the patient must remain in a supine position thereby rendering the act of drinking from a typical drinking vessel very difficult or impossible.

Content gradation marks can be provided along the sidewall 18 of the cup 14 if desired. Tube 48 can be extended for partial discharge of the contents of the dispenser and then recollapsed and positioned in the recess 50, and then reextended for subsequent discharge of still a further portion of the dispenser, without difficulty.

It is contemplated herein that the dispenser can be used as a multiple dosage dispenser as above-described or as a single dosage dispenser which is discardable after use.

While there have been described above the principles of this invention in connection with specific apparatus, it is to be clearly understood that this description is made only by way of example and not as a limitation to the scope of the invention.

What is claimed is:

1. A dosage dispenser comprising a closed container having a top, bottom and upstanding side walls, said side walls including a plurality of wall sections angularly disposed with respect to adjacent ones thereof, said sections include a plurality of joined and generally conical sections, the corresponding cross-sectional dimensions of said sections decreasing in a direction from said top to said bottom walls, said dispenser being manually collapsible between a rest condition with said top and bottom disposed in generally parallel, spaced-apart relationship and a substantially fully collapsed condition in response to pressure on said top and bottom, said wall sections defining obtuse angles with respect to each other when said container is in said rest condition, said wall sections being folded to positions disposed and at acute angles with respect to one another and said top and bottom being adjacently disposed when said container is in said collapsed condition whereby both flowable and viscous fluids are substantially fully evacuated therefrom, and a tube connected to said container and communicating with the interior thereof, said tube also being collapsible to prevent the transmission of the contents of said container through said tube.

2. The dispenser of claim 1 wherein said container top and tube are portions of an integral lid, said container bottom and sidewalls being portions of an integral cup, said cup being a separate piece from said container lid, said container side walls having an upwardly facing peripheral edge, said container lid also having a peripheral edge and further comprising means on said lid and said side wall peripheral edges for effecting a liquid-tight seal therebetween.

3. The dispenser of claim 1 wherein said container top has a peripheral edge, said tube is connected to said top adjacent to said peripheral edge so as to extend outwardly of the exterior surface of said top, said tube having a length which permits said tube to be folded into a folded position in which said tube lies adjacent the exterior top surface of said top, whereby said tube is collapsed and closed to fluid flow, said tube also having a relaxed position remotely spaced from its folded position, said tube resiliently reopening to fluid flow when moved from said folded position to said relaxed position.

4. The dispenser of claim 1 wherein said walls are integrally formed of a resilient, flexible material, said top and bottom having a greater thickness and being more rigid than said wall sections whereby said top and bottom remain substantially flat and said wall sections fold in response to pressure on said top and bottom.

5. The dispenser of claim 1 wherein said sections have decreasing dimensions in a direction from said top toward said bottom, those ones of said wall sections closer to said bottom wall being received within the next adjacent ones of said wall sections closer to said top when said container is in said collapsed condition.

6. The dispenser of claim 2 wherein said cup has upper and lower portions, both of said portions having upstanding walls, said upper portion walls having said peripheral edge and effecting means thereon, said upper portion also having a bottom with a centrally located opening therein, said lower portion having upstanding walls, the upper edge of said lower portion walls being connected to said upper portion bottom, said lower portion walls surrounding said opening in said upper portion bottom, said opening providing communication between said portions, said container lid and cup are of a thin wall construction and made of a resilient and flexible material, said construction and material thickness being such that said container top and upstanding walls of said cup are more rigid than said upper portion bottom, said upper portion bottom and said lower portion being foldable within said top portion at the junctures of said wall portions in response to pressure on said top and bottom.

7. The dispenser of claim 3 wherein said container top has a recess therein, said tube being foldable into said recess, means connected to said top adjacent to said recess for holding said tube in said recess.

8. The dispenser of claim 7 wherein said means is a partial cover of said recess remotely spaced from said tube under which the distal end of said tube may be positioned when in said folded position.

9. The dispenser of claim 6 wherein said container has an axis which extends through the centers of said container top and bottom, said container top surface and said container bottom being generally perpendicular to said axis, said container having cross-sections taken generally perpendicular to said axis that are circular in shape, said upper portion bottom and lower portion walls both being tapered with respect to said axis, said upper portion bottom being smaller in diameter adjacent to the connection thereof to said lower portion walls than remote therefrom, the cross-sections of said portions walls being larger in diameter adjacent to said connection than remote therefrom.

* * * * *